US006101660A

United States Patent [19]

Mroczka et al.

[11] Patent Number: 6,101,660

[45] Date of Patent: Aug. 15, 2000

[54] TOOTHBRUSH BRISTLE GUARD

[76] Inventors: David E. Mroczka, 57B Sagamore Hill Dr., Port Washington, N.Y. 11050; Maryann Vanderventer, 14 Martin Dr., Yulan, N.Y. 12792

[21] Appl. No.: 09/226,860

[22] Filed: Jan. 7, 1999

[51] Int. Cl.[7] ..... A46B 17/08

[52] U.S. Cl. ..... 15/167.1; 15/246; 248/110; 248/686

[58] Field of Search ..... 15/167.1, 246, 15/248.1; 248/110, 111, 682, 686, 688

[56] References Cited

U.S. PATENT DOCUMENTS

| | | | |
|---|---|---|---|
| 2,224,467 | 12/1940 | Bauerle | 15/246 |
| 2,534,439 | 12/1950 | Grand Jean | 15/248.1 |
| 3,231,919 | 2/1966 | Mac Donald | 15/246 |
| 5,044,038 | 9/1991 | Matkovic | 15/246 |
| 5,875,576 | 3/1999 | Blue | 15/248.1 |

FOREIGN PATENT DOCUMENTS

| | | | |
|---|---|---|---|
| 6674 | 3/1896 | United Kingdom | 15/246 |

*Primary Examiner*—Randall E. Chin
*Attorney, Agent, or Firm*—Alix, Yale & Ristas, LLP

[57] ABSTRACT

A toothbrush employs a bristle guard for the prevention of contamination and deformation of toothbrush bristles. The bristle guard comprises an arm, which is received within, and pivotally connected to, the toothbrush handle. The pivotal connection allows the arm to move between a guard position and a brushing position. In the guard position, the arm extends from the handle and supports the toothbrush in a rack style holder. In the brushing position, the arm is substantially received within the toothbrush handle allowing conventional use.

16 Claims, 3 Drawing Sheets

TOOTHBRUSH BRISTLE GUARD

BACKGROUND OF THE INVENTION

This invention relates generally to a device for the prevention of contamination and deformation of toothbrush bristles.

The toothbrush has become an increasingly important oral hygiene tool for the prevention of diseases of the gums and teeth. However, despite their importance, the toothbrushes currently available can expose the user to the possibility of disease and unsanitary conditions. This exposure arises from storage of the toothbrush in rack style holders. The rack style holder typically has a cutout which receives the toothbrush handle. The lengths of the toothbrush bristles however are too large to pass through the cutout, and consequently the toothbrush is supported in the rack style holder by its bristles. The surfaces of the holder can be unclean, and the bristles of the toothbrush become contaminated from contact with the unclean surfaces of rack style holders. Subsequent use of the toothbrush may unknowingly transmit the contamination to the user.

In addition to contamination, the bristles are also deformed over time due to supporting the weight of the toothbrush in this style of toothbrush holder. The bristle deformation leads to a lessening of the general effectiveness of the toothbrush as a dental hygiene tool, and a shorter useful life for the toothbrush.

A toothbrush is routinely taken along on trips so that oral hygiene can be continued while away from home. During travel, the toothbrush is usually protected by a travel container. To conserve space, the travel container closely conforms to the external shape of the toothbrush. Once at the destination, the toothbrush is removed from the travel container and stored, often in a rack style holder, with a resulting exposure to unknown and possibly unsanitary conditions.

SUMMARY OF THE INVENTION

The present invention comprises a toothbrush with a handle having a first end adapted for gripping and a plurality of bristles mounted at an opposing second end. A slot is defined within the handle. The slot may take the form of a through slot, extending through at least two surfaces of the handle, or a recess, defined within a surface of the handle. An arm is received within the slot and is pivotally connected to the handle. The pivotal connection allows the arm to move between a brushing position, where the arm is generally flush with the handle, and a guard position, where the arm projects from the handle to form a bristle guard.

In the guard position, upon insertion of the toothbrush handle into the holder, the arm will contact the toothbrush holder and support the weight of the toothbrush in the holder, to thereby preclude bristle contact with the holder. Contamination and damage to the toothbrush bristles are therefore avoided. In the brushing position, the arm is generally flush with the handle so that the toothbrush can be used in a conventional manner. In addition, since the arm does not change the exterior profile of the toothbrush, travel holders conforming to the external shape of conventional toothbrushes can be used.

An object of the invention is to provide a new and improved toothbrush adapted to prevent the possible contamination of toothbrush bristles during storage in a rack style holder.

Another object of the invention is to provide a new and improved toothbrush adapted to prevent deformation of toothbrush bristles during storage in a rack style holder.

A further object of the invention to provide a new and improved toothbrush having an efficient and low-cost construction which prevents the contamination and deformation of toothbrush bristles.

Still another object of the invention is to provide a new and improved toothbrush which is less susceptible to contamination and damage to toothbrush bristles without interfering with the normal motions associated with the act of brushing teeth.

BRIEF DESCRIPTION OF THE DRAWINGS

Other objects and advantages of the invention will be evident from the following detailed description made with reference to the accompanying drawings, in which.

DESCRIPTION OF THE PREFERRED EMBODIMENTS

Figure 1:
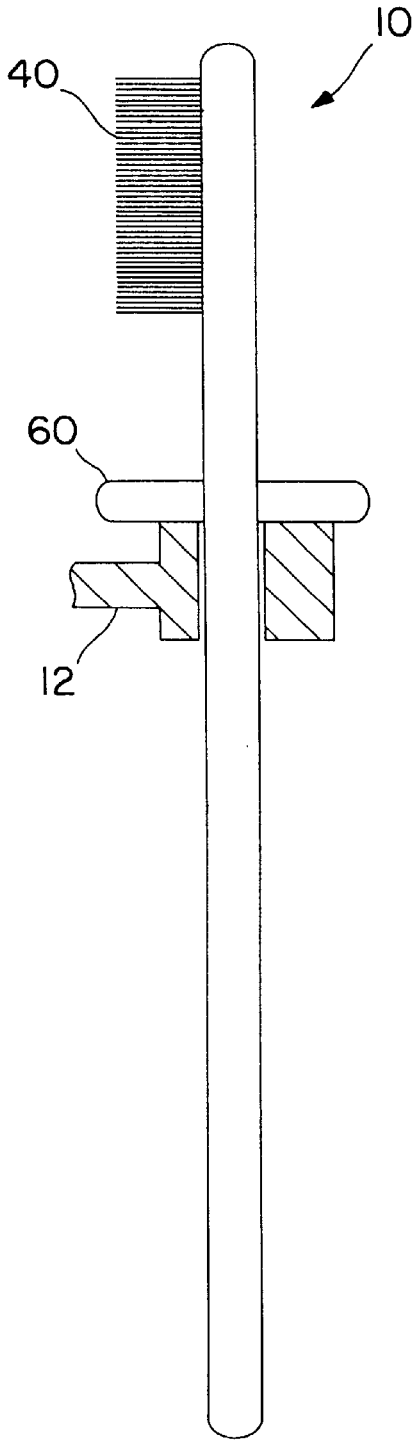
FIG. 1 is a side elevational view of a toothbrush incorporating a bristle guard in accordance with the invention and shown mounted in a rack style holder partially illustrated in section.

In the following description of the preferred embodiments, like reference numerals represent identical or corresponding parts throughout the different Figures.

Figure 2:
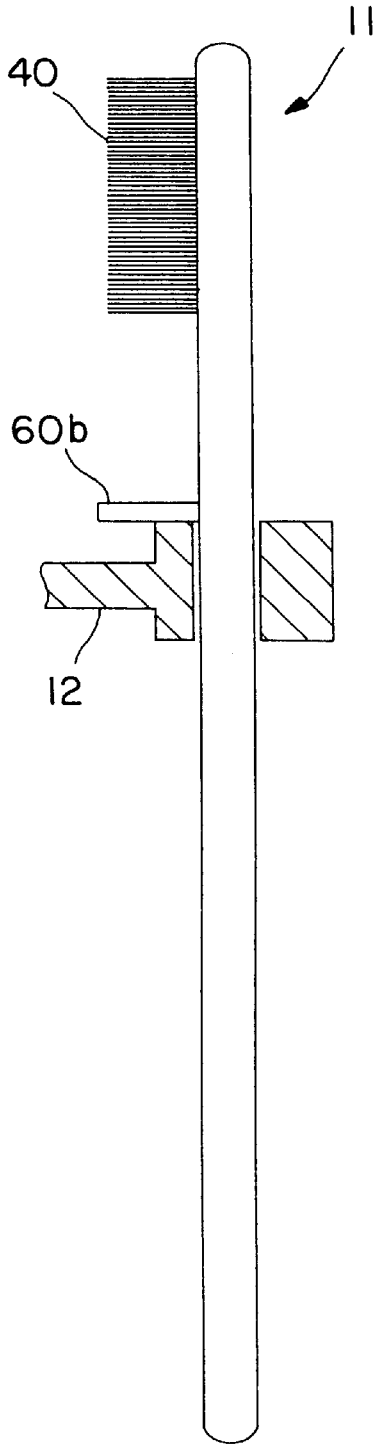
FIG. 2 is a side elevational view of a toothbrush incorporating a second embodiment of a bristle guard, also shown mounted in a rack style holder partially illustrated in section.

FIG. 1 shows one embodiment of a toothbrush incorporating a bristle guard and generally designated by the numeral 10. The toothbrush 10 is supported by an arm 60 in a rack style holder 12. FIG. 2 shows a toothbrush with a different embodiment of the bristle guard, generally designated 11. As in the previous Figure, an arm **60*b* supports the toothbrush 10 in the rack style holder 12. In either embodiment, the bristles 40 do not contact the rack style holder 12** thereby avoiding contamination and deformation of the toothbrush bristles.

Figure 3:
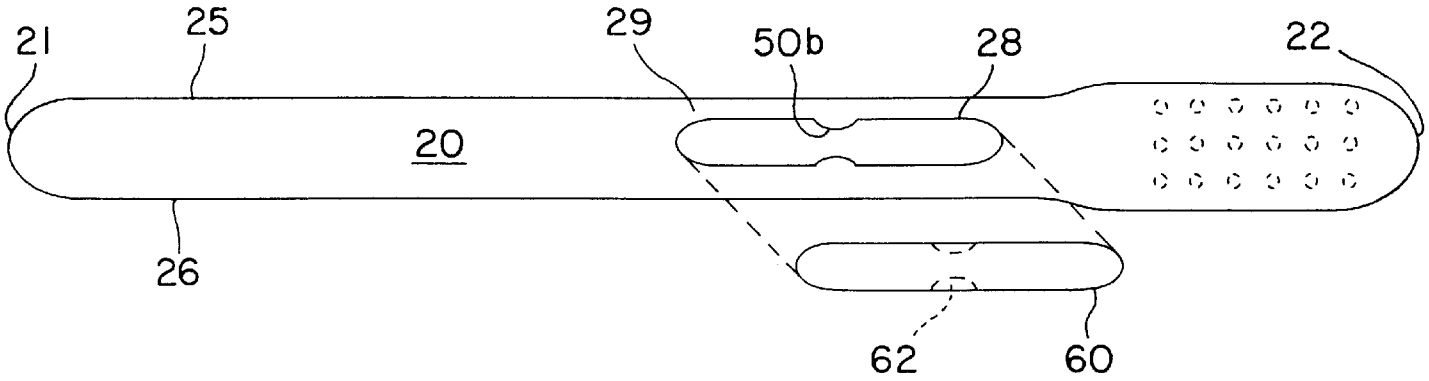
FIG. 3 is an exploded top view, partially in phantom, of the toothbrush shown in FIG. 1.
Figure 4:
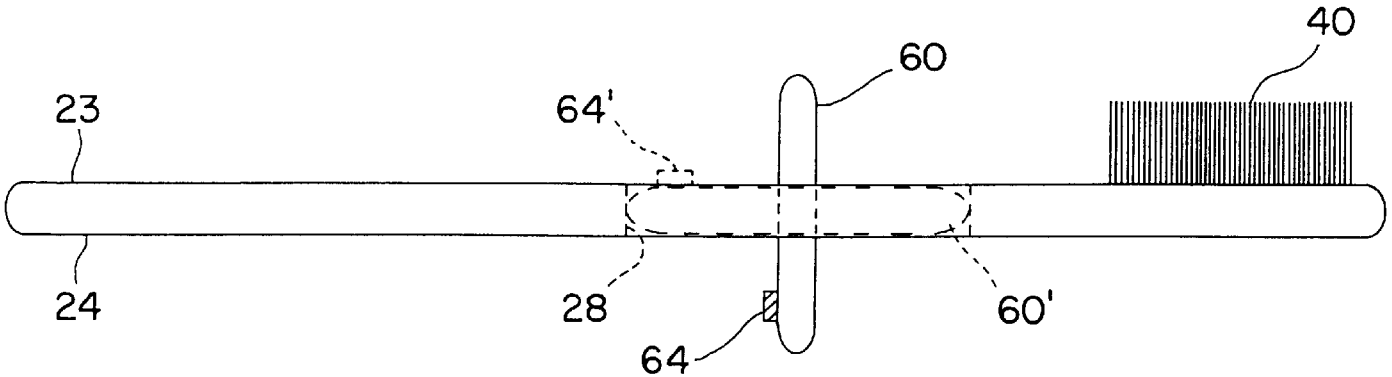
FIG. 4 is a side view, partially in phantom, of the toothbrush of FIG. 1.

The toothbrush, as shown in FIGS. 3 and 4, comprises a handle 20, with a first end 21 adapted for gripping and an opposing second end 22 adapted to hold a matrix of bristles 40. The bristles 40 extend generally orthogonally from a working side 23 of the handle. The handle 20 contains a through slot 28, located between the first end 21 and the bristles 40. In one embodiment, the slot is elongated, generally parallel to the longitudinal axis of the handle, and extends from the top side 23 through the opposing bottom side 24 of the handle.

An arm 60, fits within the through slot 28 and is connected to the handle 20 by a pivot. The pivot allows the arm to move by manual manipulation of the toothbrush user between a brushing position and a guard position. In the brushing position, 60' in FIG. 4, the arm is received within the through slot in a stable position which is generally flush with the handle surfaces. In the guard position 60, the arm extends from the handle, as shown in FIGS. 1 and 4. The arm 60, as shown in FIG. 4, can optionally have a raised portion 64 projecting above the handle surface when the arm is in the brushing position. The raised portion 64 makes manual actuation from the brushing position to the safety position easier.

The size and orientation of the through slot and arm are capable of many variations. As examples (not shown), the through slot may extend from the left side 25 through the right side 26 or extend transversely to the handle longitudinal axis. As long as the arm is movable to a guard position extending from the handle such that the toothbrush is supported by the arm 60 in the holder 12, as shown in FIG. 1, bristle contamination and deformation are avoided.

Preferably, the pivot comprises a pair of integral pivot bumps 50*b*, which fit within and engage a pair of mating recesses 62. The pivot bumps may extend transversely from the walls 29 of the through slot 28, as shown in FIG. 3. The arm 60 defines the mating recesses 62 at opposed intermediate edge locations of the arm. Alternatively, the arm may comprise opposing pivot bumps (not shown), which rotatably engage recesses defined within the through slot walls (not shown). In either embodiment, the flexibility of the handle 20 in the slot region allows the walls 29 of the through slot 28 to flex, so the pivot components contained on the walls ride over the arm, and snap into engagement with the mating pivot components contained on the arm.

Figure 5:
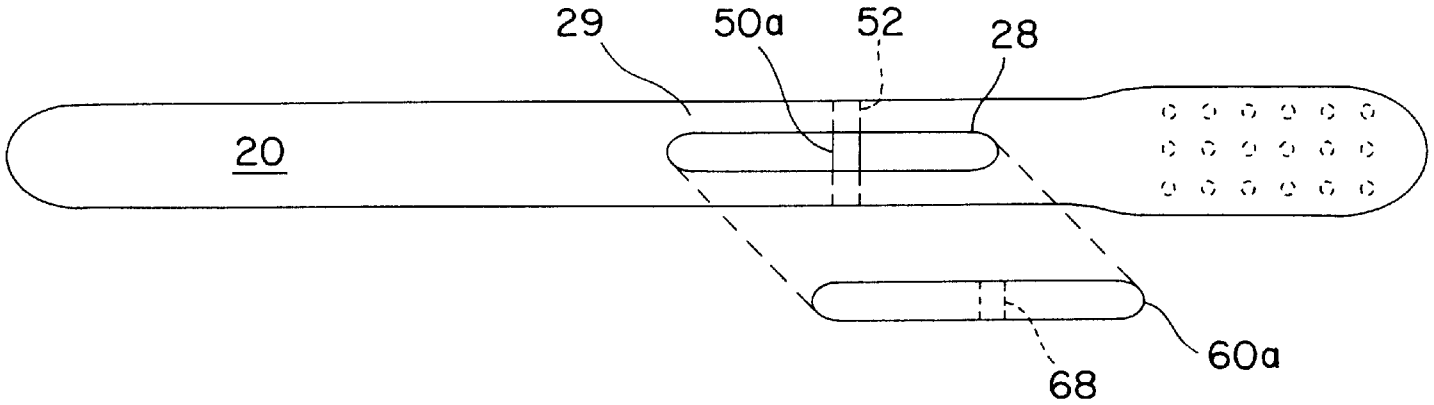
FIG. 5 is an exploded top view, partially in phantom, of a modified embodiment of the toothbrush of FIG. 1.

An alternative pivot is shown in FIG. 5. It comprises a pair of transverse, axially aligned apertures 52 defined in the walls 29 of the through slot 28. The arm 60*a* also has a transverse aperture 68. With the arm positioned within the through slot, the apertures of the slot walls and arm, 52 and 68 respectively, are in axial alignment. A pivot pin 50*a* is inserted through the aligned apertures. The arm 60*a* is thereby limited to rotational movement around the pin 50*a*.

Engagement of the pivot means can be varied from a loose fit, where the arm is retained by the pivot means but freely rotates, to an interference fit, where tension between the mating pivot means will hold the arm in a stable rotational position unless changed by the user. Alternatively, the shape of the pivot bumps and recesses can be chosen so that the arm position is fixable by the user in defined positions. This could be accomplished by, for instance, molded serrations on the bumps (not shown) and the mating recesses (not shown).

Figure 6:
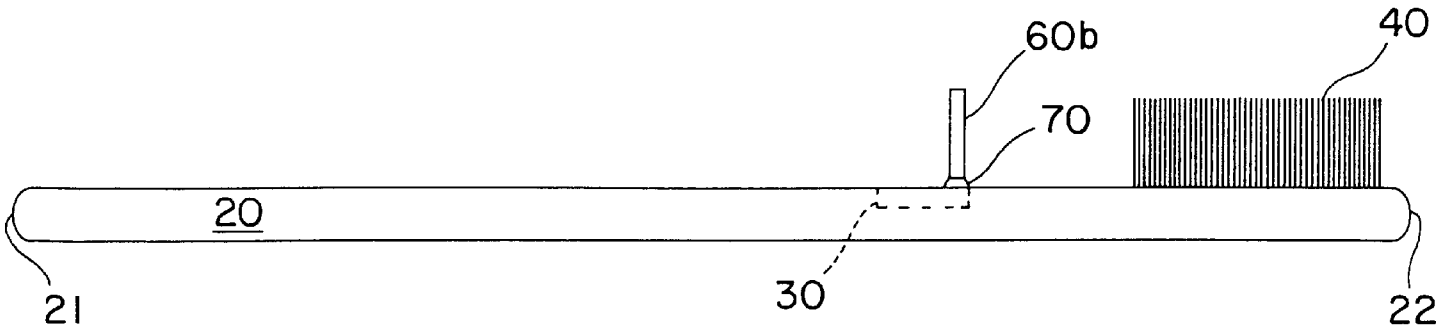
FIG. 6 is a side view, partially in phantom, of the toothbrush shown in FIG. 2.

In another embodiment of the invention, shown in FIG. 6, the handle 20 defines a recess 30. The recess 30 may be defined within any side of the handle and intermediate between the first end 21 and the bristles 40. An arm 60*b* is connected to the handle 20 by a hinge 70. In this embodiment, the arm 60*b* is substantially received within the recess 30, and is generally flush with the handle in the brushing position. In the guard position, the arm 60*b* extends from the handle, as shown in FIGS. 2 and 6. The positions of the recess 30, arm 60*b* and hinge 70 are capable of many variations. As long as the arm is movable to a guard position extending at an angle to the handle such that the toothbrush is supported by the arm in the holder 12, as shown in FIG. 2, bristle contamination and deformation are avoided. In one embodiment, the hinge is a "living hinge" wherein the arm 60*b*, the hinge 70 and the handle 20 are integrally molded.

For the disclosed embodiments, the arm 60, 60*a* or 60*b* will be at least partially received within the handle in the brushing position. This allows storage of the toothbrush in conforming travel holders. Further, in this position, the bristle guard does not interfere with the normal motions associated with using a toothbrush. After use, the arm is moved to the guard position and the toothbrush is placed in a rack style holder. The arm supports the toothbrush in the holder, preventing contact of the bristles with the holder. Bristle contamination and deformation are therefore avoided.

While preferred embodiments of the foregoing invention have been set forth for purposes of illustration, the foregoing description should not be deemed a limitation of the invention herein. Accordingly, various modifications, adaptations, and alternatives may occur to one skilled in the art without departing from the spirit and scope of the present invention.

What is claimed is:

1. A toothbrush, comprising:

a handle having opposing first and second ends and a plurality of sides;

a plurality of bristles extending from a side of said second end;

said handle defining a slot with slot walls between the first end and the bristles;

an arm receivable within said slot, the arm having opposing ends; and pivot means for pivotally connecting said arm to said handle;

so that the arm can pivot between a brushing position wherein the arm is substantially received within the slot and a guard position wherein the arm extends outwardly from the handle.

2. A toothbrush as in claim 1, wherein said slot extends through the handle from a first side through a second side.

3. A toothbrush as in claim 1, wherein:

said handle has a longitudinal axis; and said slot is parallel to the longitudinal axis.

4. A toothbrush as in claim 1, wherein said pivot means is transverse to said slot walls and intermediate to said arm ends.

5. A toothbrush as in claim 1, wherein said pivot means comprises:

a pair of transverse, axially aligned apertures defined in the slot walls;

an aperture defined in the arm; and a pin disposed within said apertures.

6. A toothbrush as in claim 1, wherein said pivot means comprises:

a pair of axially aligned pivot bumps extending transversely from said slot walls; and a pair of recesses defined in said arm rotatably engaging with said pivot bumps.

7. A toothbrush as in claim 1, wherein said pivot means comprises:

a pair of axially aligned pivot bumps extending transversely from said arm; and a pair of recesses defined in said slot walls rotatably engaging with said pivot bumps.

8. A toothbrush as in claim 1, wherein said arm is generally flush with said handle in the brushing position.

9. A toothbrush as in claim 1, wherein said arm has a raised portion.

10. A toothbrush as in claim 1, wherein said arm is fixable at a plurality of positions between the brushing position and the guard position.

11. A toothbrush as in claim 1, wherein both ends of the arm extend from the handle in the guard position.

12. A toothbrush, comprising:

a handle having opposing first and second ends, said handle defining a recess;

a plurality of bristles extending from a side of said second end;

an arm receivable within said recess; and a hinge connecting said arm to said handle;

so that the arm can pivot from a brushing position wherein the arm is received within the recess to a guard position wherein the arm extends outwardly from the handle.

13. A toothbrush as in claim 12, wherein the handle, the hinge and the arm are integrally formed.

14. A toothbrush as in claim 12, wherein the hinge connects the arm to the recess.

15. A toothbrush as in claim 12, wherein:

the arm has at least one edge; and the hinge connects the edge to the handle.

16. A toothbrush as in claim 12, wherein the recess is defined between the handle first end and the bristles.

* * * * *